US008940062B2

(12) United States Patent
Katagiri

(10) Patent No.: US 8,940,062 B2
(45) Date of Patent: Jan. 27, 2015

(54) METHOD AND APPARATUS FOR CONTROLLING TEMPERATURE IN COMBUSTION FURNACE IN GASIFICATION EQUIPMENT

(75) Inventor: Tomoyuki Katagiri, Tokyo (JP)

(73) Assignee: IHI Corporation, Tokyo (JP)

( * ) Notice: Subject to any disclaimer, the term of this patent is extended or adjusted under 35 U.S.C. 154(b) by 523 days.

(21) Appl. No.: 13/395,203

(22) PCT Filed: Oct. 22, 2010

(86) PCT No.: PCT/JP2010/006255

§ 371 (c)(1),
(2), (4) Date: Mar. 9, 2012

(87) PCT Pub. No.: WO2011/052170

PCT Pub. Date: May 5, 2011

(65) Prior Publication Data

US 2012/0167462 A1 Jul. 5, 2012

(30) Foreign Application Priority Data

Oct. 28, 2009 (JP) ..... 2009-247623

(51) Int. Cl.
*C01B 3/36* (2006.01)
*B01J 7/00* (2006.01)
(Continued)

(52) U.S. Cl.
CPC ..... *F23C 10/28* (2013.01); *C10J 3/723* (2013.01); *C10J 3/482* (2013.01); *C10J 3/503* (2013.01);
(Continued)

(58) Field of Classification Search
CPC ..... C10J 3/723; F23C 10/28
See application file for complete search history.

(56) References Cited

U.S. PATENT DOCUMENTS 4,489,562 A * 12/1984 Snyder et al. ..... 60/667
4,597,771 A * 7/1986 Cheng ..... 48/77
(Continued)

FOREIGN PATENT DOCUMENTS

JP 04 088086 3/1992
JP 2002 130647 5/2002
(Continued)

OTHER PUBLICATIONS

International Search Report issued on Nov. 22, 2010 in PCT/JP10/06255 filed on Oct. 22, 2010.

*Primary Examiner* — Imran Akram
(74) *Attorney, Agent, or Firm* — Oblon, Spivak, McClelland, Maier & Neustadt, L.L.P.

(57) ABSTRACT

A char 7 feed rate at a rated point determined from a relationship between a current water vapor 3 flow rate and a current raw material 5 charge rate to a gasification furnace 1 is multiplied by a proper number determined from a relationship between a current gasification furnace 1 temperature and a current bed material 4 circulated rate to calculate an actual char 7 feed rate. A subtraction is performed between a gross heat value of the char 7 flowing into the combustion furnace 2 determined on the basis of the calculated char 7 feed rate and a heat value required for keeping a top of the combustion furnace 2 at a commanded temperature determined from a relationship between the commanded temperature and an air flow rate in the furnace 2 to determine a heat value required for keeping the combustion furnace 2 at the commanded temperature. An auxiliary fuel operation rate is determined from the determined heat value to perform an advanced control for an auxiliary fuel feeder 21 and is regulated such that a difference as a result of subtraction between the commanded and detected temperatures in the top of the furnace 2 becomes zero to perform a feedback control for the feeder 21.

2 Claims, 6 Drawing Sheets

(51) Int. Cl.

| | |
|---|---|
| ***F23C 10/28*** | (2006.01) |
| ***C10J 3/72*** | (2006.01) |
| ***C10J 3/48*** | (2006.01) |
| ***C10J 3/50*** | (2006.01) |

(52) U.S. Cl.

CPC .... *C10J 2300/0996* (2013.01); *C10J 2200/158* (2013.01); *C10J 2300/0976* (2013.01); *C10J 2300/1807* (2013.01); *C10J 2300/1853* (2013.01)

USPC ..... 48/197 R; 48/61

(56) References Cited

U.S. PATENT DOCUMENTS

| | | | | |
|---|---|---|---|---|
| 5,688,296 | A * | 11/1997 | Andrus et al. | 48/197 R |
| 6,485,296 | B1 * | 11/2002 | Bender et al. | 432/58 |
| 2003/0046868 | A1 * | 3/2003 | Lewis | 48/197 R |
| 2004/0261316 | A1 * | 12/2004 | Weaver | 48/210 |
| 2006/0112639 | A1 * | 6/2006 | Nick et al. | 48/198.1 |
| 2007/0006528 | A1 * | 1/2007 | Diebold et al. | 48/197 R |
| 2007/0289216 | A1 * | 12/2007 | Tsangaris et al. | 48/197 R |
| 2008/0147241 | A1 * | 6/2008 | Tsangaris et al. | 700/273 |
| 2008/0202028 | A1 * | 8/2008 | Tsangaris et al. | 48/73 |
| 2008/0209807 | A1 * | 9/2008 | Tsangaris et al. | 48/89 |
| 2008/0210089 | A1 * | 9/2008 | Tsangaris et al. | 95/90 |
| 2008/0222956 | A1 * | 9/2008 | Tsangaris et al. | 48/77 |
| 2009/0151315 | A1 * | 6/2009 | Kamohara et al. | 60/39.24 |
| 2009/0277089 | A1 * | 11/2009 | Neathery | 48/76 |
| 2010/0101146 | A1 | 4/2010 | Fujimori et al. | |
| 2010/0275781 | A1 * | 11/2010 | Tsangaris et al. | 96/108 |
| 2011/0036014 | A1 * | 2/2011 | Tsangaris et al. | 48/62 R |
| 2011/0308230 | A1 * | 12/2011 | Takase et al. | 60/39.182 |
| 2012/0055088 | A1 * | 3/2012 | Steele et al. | 48/89 |

FOREIGN PATENT DOCUMENTS

| | | |
|---|---|---|
| JP | 3933105 | 6/2007 |
| JP | 2008 94928 | 4/2008 |
| WO | 2008 107928 | 9/2008 |

* cited by examiner

FIG. 3

FEED RATE OF CHAR TO COMBUSTION FURNACE (kg/h)

| RATE OF RAW MATERIAL (kg/h) | 100 | 200 | 300 | 400 |
|---|---|---|---|---|
| 400 | 40 | 36 | 32 | 28 |
| 300 | 30 | 27 | 24 | 21 |
| 200 | 20 | 18 | 16 | 14 |
| 100 | 10 | 9 | 8 | 7 |

RATE OF WATER VAPOR (kg/h)

FIG. 4

INFLUENCE NUMBER

| CIRCULATED RATE OF BED MATERIAL (10,000 kg/h) | 700 | 800 | 900 | 1000 | 1100 |
|---|---|---|---|---|---|
| 5 | 1. 44 | 1. 2 | 0. 96 | 0. 72 | 0. 48 |
| 4 | 1. 2 | 1 | 0. 8 | 0. 6 | 0. 4 |
| 3 | 0. 96 | 0. 8 | 0. 64 | 0. 48 | 0. 32 |
| 2 | 0. 72 | 0. 6 | 0. 48 | 0. 36 | 0. 24 |
| 1 | 0. 48 | 0. 4 | 0. 32 | 0. 24 | 0. 16 |

TEMPERATURE OF GASIFICATION FURNACE (°C)

HEAT VALUE REQUIRED FOR KEEPING COMMANDED TEMPERATURE IN UNITS OF 100,000 kJ/h

| FLOWRATE OF AIR TO COMBUSTION FURNACE ($m^3/h$) | 700 | 800 | 900 | 1000 |
|---|---|---|---|---|
| 5000 | 0.72 | 0.96 | 1.2 | 1.44 |
| 4000 | 0.6 | 0.8 | 1 | 1.2 |
| 3000 | 0.48 | 0.64 | 0.8 | 0.96 |
| 2000 | 0.36 | 0.48 | 0.6 | 0.72 |

COMMANDED TEMPERATURE IN TOP OF COMBUSTION FURNACE (°C)

METHOD AND APPARATUS FOR CONTROLLING TEMPERATURE IN COMBUSTION FURNACE IN GASIFICATION EQUIPMENT

TECHNICAL FIELD

The present invention relates to a method and an apparatus for controlling a temperature in a combustion furnace in a gasification equipment.

BACKGROUND

It has been recently proposed in view of probable petroleum depletion to perform gasification using, as raw material, petroleum coke which is residue in petroleum refinery and/or any resource currently not efficiently utilized such as oilsand, bitumen, brown or other low-quality coal or other fossil fuel, biomass and/or tire chips so as to produce and efficiently utilize a gasification gas comprising hydrogen, hydrocarbon and the like.

FIG. 1 schematically shows an example of a gasification equipment for production of the gasification gas, which is of a twin column type comprising gasification and combustion furnaces 1 and 2. Water vapor 3 is fed to a bottom of the gasification furnace 1 to form a fluidized bed of a bed material 4 (silica sand, limestone, etc.) for gasification of a raw material 5 (coal, biomass, waste plastics, etc.) charged into the fluidized bed, a resultant gasification gas 6 being fed to a gas refining system.

The bed material 4 in the gasification furnace 1 overflows, together with unreacted char 7 produced in the furnace 1, through a duct 1*a* on the furnace 1 into the combustion furnace 2 where the bed material 4 is blown up by air 8 introduced to a bottom of the furnace 2 with the char 7 being burned to heat the bed material 4.

A combustion exhaust gas 9 blown up together with the bed material 4 in the combustion furnace 2 is introduced through a top of the furnace 2 into a cyclone 10 where the bed material 4 is separated and returned via a downcomer 11 to the gasification furnace 1 while the combustion exhaust gas 9 is taken through a top of the cyclone 10 and fed to an exhaust gas treatment system.

When a rate of the char 7 flowing from the gasification furnace 1 into the combustion furnace 2 runs short, the furnace 2 is fed with an auxiliary fuel F such as coal to keep constant a temperature of the bed material in the furnace 2 or a temperature in the top of the furnace 2.

Disposed between the gasification and combustion furnaces 1 and 2 and between the furnace 1 and the downcomer 11 are seals 12 and 13, respectively, in the form of U-shaped ducts for prevention of the gasification gas from being transported.

Prior art literatures on a gasification equipment relevant to the invention are, for example, Patent literatures 1, 2 and 3.

CITATION LIST

Patent Literature

[Patent Literature 1] JP2002-130647A
[Patent Literature 2] JP4-88086A
[Patent Literature 3] JP3933105B

SUMMARY OF INVENTION

Technical Problems

However, in the twin-column gasification equipment with the gasification and combustion furnaces as mentioned in the above, a heat value and a flow rate of the char fed from the gasification furnace to the combustion furnace vary greatly depending on a temperature in the gasification furnace, a flow rate of water vapor, a charge rate of the raw material and a circulated rate of the bed material. Thus, it has been difficult to determine the heat value and flow rate of the char flowing into the combustion furnace.

Moreover, use of the temperature of the bed material in the combustion furnace or the temperature in the top of the combustion furnace, which varies with a large time constant, for a feedback control of a rate of an auxiliary fuel (the rate of coal) charged into the combustion furnace may result in substantial variation of the temperature in the combustion furnace, leading to variation in heat value of the bed material fed to the gasification furnace at a rear of the combustion furnace and variation in yield of the water vapor from the combustion exhaust gas on a heat transfer surface of a heat exchanger. As a result, disadvantageously, a stable operation of the gasification furnace may not be secured.

The invention was made in view of the above and has its object to grasping a feed rate and a heat value of char fed from a gasification furnace to a combustion furnace to control a temperature in the combustion furnace with a high accuracy.

Solution to Problems

The invention is directed to a method for controlling a temperature in a combustion furnace in a gasification equipment comprising a gasification furnace for gasifying a raw material through formation of a fluidized bed by introduction of water vapor and a combustion furnace for blowing up with air the bed material introduced together with unreacted char from said gasification furnace to heat the bed material through combustion of said char, the bed material heated in said combustion furnace being separated from a combustion exhaust gas and returned to said gasification furnace, the method comprising:

providing a first map for defining a feed rate of the char from the gasification furnace to the combustion furnace on the basis of a rate of the water vapor and a rate of the raw material to the gasification furnace at a rated point and a second map for defining as number an influence of a temperature in the gasification furnace and a circulated rate of the bed material on said feed rate of the char;

reading out the feed rate of the char at the rated point from a current rate of the water vapor and a current rate of the raw material to the gasification furnace according to the first map, reading out an influence number from a current temperature in the gasification furnace and a current circulated rate of the bed material according to the second map, and multiplying the feed rate of the char at said rated point by said influence number to thereby calculate an actual feed rate of the char;

providing a third map for defining a gross heat value of the char flowing into the combustion furnace on the basis of said actual feed rate and heat value of the char, and a fourth map for defining a heat value required for keeping a top of the combustion furnace at a commanded temperature on the basis of the commanded temperature in the top of the combustion furnace and a flow rate of air to the combustion furnace;

reading out the gross heat value of the char flowing into the combustion furnace according to said third map, reading out the heat value required for keeping the top of the combustion furnace at the commanded temperature according to the fourth map and performing a subtraction between the both to thereby calculate a heat value required for keeping the temperature in the combustion furnace;

providing a fifth map for determining an operation rate of an auxiliary fuel from said required heat value to perform an advanced control for an auxiliary fuel feeder so as to achieve said operation rate of the auxiliary fuel; and providing a proportional integrator for adding a regulated operation rate to said auxiliary fuel operation rate so as to make zero a difference obtained as a result of subtraction between the commanded temperature and a detected temperature in the top of said combustion furnace to perform a feedback control for said auxiliary fuel feeder.

The invention is also directed to an apparatus for controlling a temperature in a combustion furnace in a gasification equipment comprising a gasification furnace for gasifying a raw material through formation of a fluidized bed by introduction of water vapor and a combustion furnace for blowing up with air the bed material introduced together with unreacted char from said gasification furnace to heat the bed material through combustion of said char, the bed material heated in said combustion furnace being separated from a combustion exhaust gas and returned to said gasification furnace, the apparatus comprising:

water vapor rate detection means for detecting a rate of the water vapor to the gasification furnace;

raw material rate detection means for detecting a rate of the raw material to the gasification furnace;

gasification furnace temperature detection means for detecting a temperature in the gasification furnace;

bed material circulated rate detection means for detecting a circulated rate of the bed material;

combustion furnace air flow rate detection means for detecting a flow rate of air to the combustion furnace;

combustion furnace temperature detection means for detecting a temperature in a top of the combustion furnace;

auxiliary fuel feed rate detection means for detecting a feed rate of an auxiliary fuel to the combustion furnace; and a controller with a first map for defining a feed rate of the char from the gasification furnace to the combustion furnace on the basis of the rate of the water vapor and the rate of the raw material to the gasification furnace at a rated point; a second map for defining as number an influence of the temperature of the gasification furnace and the circulated rate of the bed material on said feed rate of the char; a multiplier for multiplying the feed rate of the char at a rated point read out from a current rate of the water vapor and a current rate of the raw material to the gasification furnace according to the first map by the number read out from a current temperature in the gasification furnace and a current circulated rate of the bed material according to the second map to thereby calculate an actual feed rate of the char;

a third map for defining a gross heat value of the char flowing into the combustion furnace on the basis of said actual feed rate and heat value of the char and;

a subtracter for performing a subtraction between the gross heat value of the char flowing into the combustion furnace read out according to said third map and the heat value required for keeping the top of the combustion furnace at the commanded temperature read out from the commanded temperature in the top of the combustion furnace and the flow rate of air to the combustion furnace according to the fourth map to determine an heat value required for keeping the combustion furnace at the commanded temperature;

a fifth map for readout of an operation rate of an auxiliary fuel from said required heat value so as to output an advanced command to an auxiliary fuel feeder; and a subtracter for a subtraction between said commanded temperature and a detected temperature in the top of said combustion furnace and a proportional integrator for regulating said operation rate of the auxiliary fuel such that a difference obtained by the subtracter becomes zero so as to provide a feedback control for said auxiliary fuel feeder.

Advantageous Effects of Invention

A method and an apparatus for controlling a temperature in a combustion furnace in a gasification equipment of the invention can provide excellent effects that a feed rate of char from a gasification furnace to a combustion furnace can be definitely grasped and that a temperature in the combustion furnace can be controlled at a high accuracy by determining a heat value required for keeping the combustion furnace at a commanded temperature through subtraction between a gross heat value of the char flowing into the combustion furnace determined on the basis of said grasped feed rate of the char and a heat value required for keeping the combustion furnace at the commanded temperature determined from a relationship between the commanded temperature in the top of the combustion furnace and a flow rate of air to the combustion furnace, by determining an operation rate of an auxiliary fuel from said determined heat value to perform an advanced control for an auxiliary fuel feeder, and by executing a subtraction between the commanded temperature and a detected temperature in the top of the combustion furnace to regulate the operation rate of the auxiliary fuel such that a difference therebetween becomes zero to perform a feedback control for the auxiliary fuel feeder.

BRIEF DESCRIPTION OF DRAWINGS

FIG. 3 is a diagram exemplarily showing a first map provided for a controller in FIG. 2;

FIG. 4 is a diagram exemplarily showing a second map provided for the controller in FIG. 2;

DESCRIPTION OF EMBODIMENT

An embodiment of the invention will be described with reference to the accompanying drawings.

Figure 1:
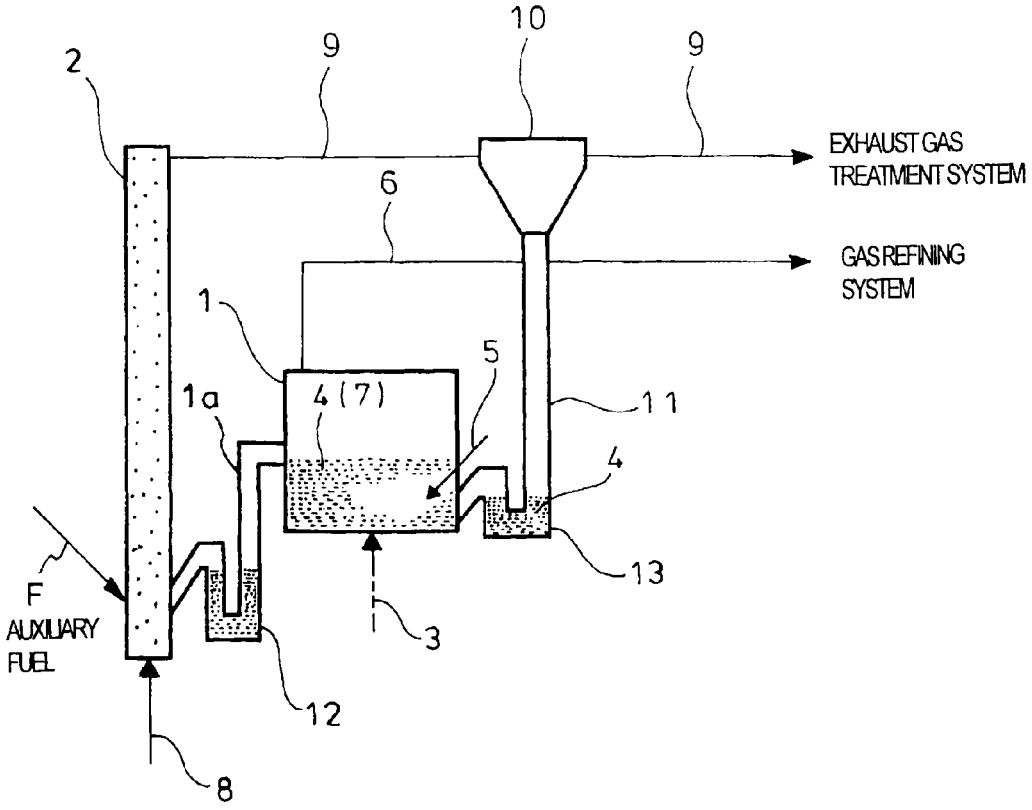
FIG. 1 is a block diagram schematically showing a conventional twin-column gasification equipment.
Figure 2:
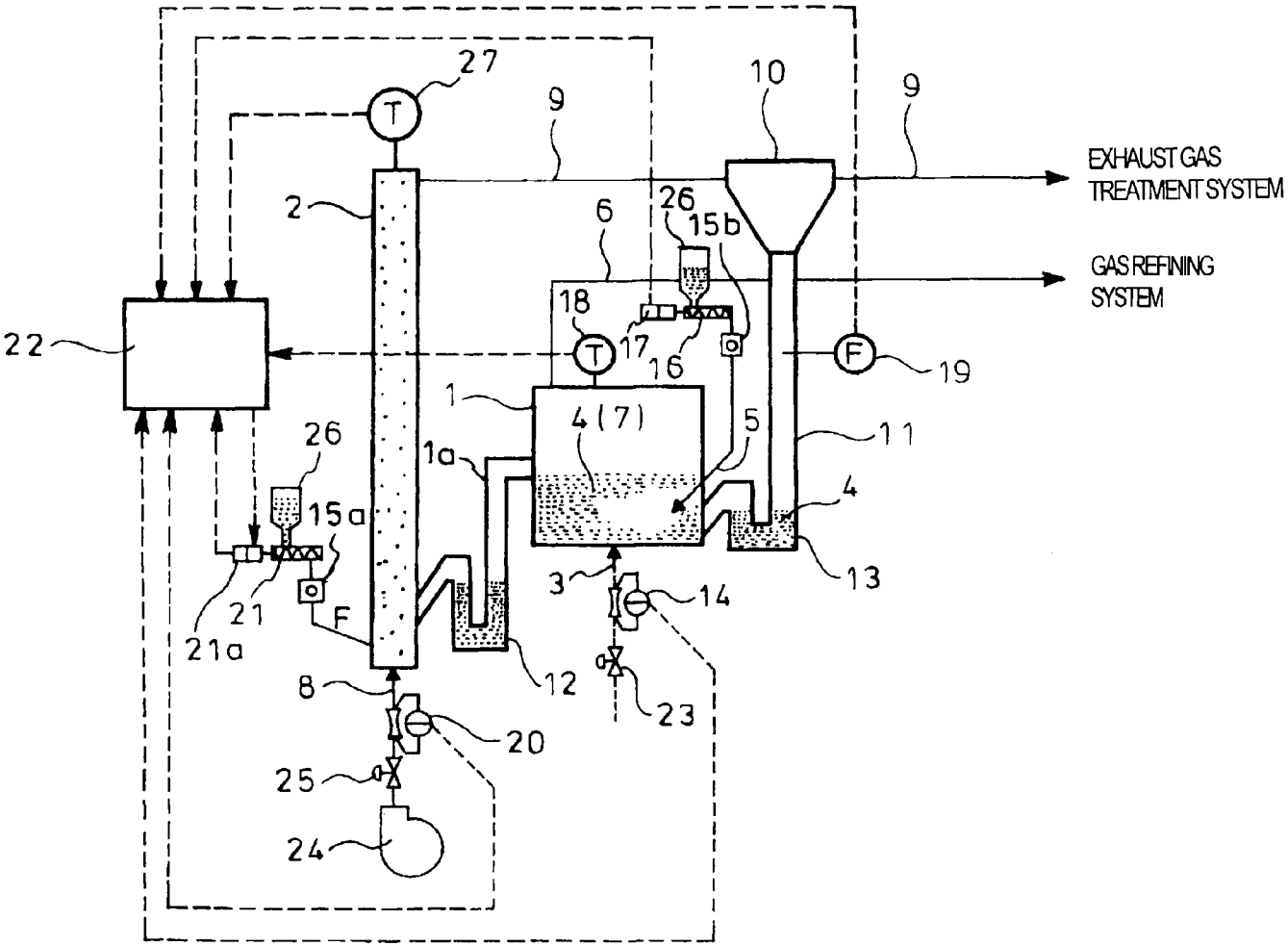
FIG. 2 is a block diagram showing an embodiment of the invention.

FIGS. 2 to 8 show the embodiment of the invention in which parts similar to those in FIG. 1 are designated by the same reference numerals and which has a basic structure similar to that shown in FIG. 1. The embodiment of the invention comprises, as shown in FIG. 2, a flowmeter for water vapor 14 (water vapor rate detection means) for detection of a flow rate of water vapor 3 (the water vapor rate) to a gasification furnace 1, a revolution sensor 17 (raw material rate detection means) for detection, as a substitute value for a charge rate of a raw material 5 (the raw material rate), of a number of revolutions of a screw conveyor 16 which feeds the raw material 5 via a gate valve 15*b* to the gasification furnace 1, a thermometer for a gasification furnace 18 (gasification furnace temperature detection means) for detection of a temperature in the gasification furnace 1, a flowmeter for circulated bed material 19 (circulated bed material flow rate detection means) incorporated in a downcomer 11 to detect a circulated rate of the bed material 4, an air flowmeter 20 for the combustion furnace (combustion furnace air flow rate detection means) for detection of a flow rate of air 8 (the air rate) to the combustion furnace 2, a revolution sensor 21*a* (auxiliary fuel rate detection means) for detection, as a substitute value for a charge rate of an auxiliary fuel F (the auxiliary fuel rate), of a number of revolutions of a screw conveyor 21 (auxiliary fuel feeder) for feed of the auxiliary fuel F via a gate valve 15*a* to the combustion furnace 2, a thermometer for combustion furnace 27 (combustion furnace temperature detection means) for detection of a temperature in the top of the combustion furnace 2 and a controller 22 for control of a temperature in the combustion furnace 2 through input of detection signals from the respective detection means. In FIG. 2, reference numeral 23 denotes a water vapor flow control valve; 24, an air fan; 25, an airflow control valve; and 26, a bunker.

The controller 22 is provided with a first map as shown in FIG. 3 which defines the feed rate of the char 7 from the gasification furnace 1 to the combustion furnace 2 on the basis of the rate of the water vapor and the rate of the raw material to the gasification furnace 1 at a given rated point (e.g., at an operation state where the circulated rate of the bed material is 40000 kg/h and the temperature in the gasification furnace is 800° C.).

Referring to the first map, when the raw material is charged into the gasification furnace 1, e.g., with the rate$_{act}$ (actual value) of the water vapor or the water vapor rate$_{act}$ (actual value) of 150 kg/h and with the rate$_{act}$ (actual value) of the raw material or the raw material rate$_{act}$ (actual value) of 125 kg/h, the feed rate of the char 7 or the char 7 feed rate can be calculated to be 11.875 kg/h from Equation (1) below according to the first map.

[Eq. 1]

$$\text{Char feed rate} = 10 \times \frac{1}{2} \times \frac{3}{4}(A) + 9 \times \frac{1}{2} \times \frac{3}{4}(B) + 20 \times \frac{1}{2} \times \frac{1}{4}(C) + 18 \times \frac{1}{2} \times \frac{1}{4}(D) = 11.875 \text{ [kg/h]} \quad (1)$$

Next, Equation (1) will be explained.

With the water vapor rate$_{act}$ of 150 kg/h and the raw material rate$_{act}$ of 125 kg/h, it can be seen in terms of regions of the first map in FIG. 3 that the water vapor rate lies within a region from the water vapor rate$_{min}$ of 100 [kg/h] to the water vapor rate$_{max}$ of 200 [kg/h] and that the raw material rate lies within a region from the raw material rate$_{min}$ of 100 [kg/h] to the raw material rate$_{max}$ of 200 [kg/h]. Using the first map, the char 7 feed rate can be calculated as follows from (water vapor rate$_{min}$, raw material rate$_{min}$)=(100 kg/h, 100 kg/h)=10 [kg/h], (water vapor rate$_{max}$, raw material rate$_{min}$)=(200 kg/h, 100 kg/h)=9 [kg/h], (water vapor rate$_{min}$, raw material rate$_{max}$)=(100 kg/h, 200 kg/h)=20 [kg/h] and (water vapor rate$_{max}$, raw material rate$_{max}$)=(200 kg/h, 200 kg/h)=18 [kg/h].

A-term of Eq. (1)

Char feed rate on the map=(water vapor rate$_{min}$, raw material rate$_{min}$)=(100 kg/h, 100 kg/h)=10 [kg/h]

Weighting factor based on the water vapor rate=(water vapor rate$_{max}$ of 200 [kg/h]−water vapor rate$_{act\ of}$ 150 [kg/h])/region span of 100 [kg/h]=½

Weighting factor based on the raw material rate=(raw material rate$_{max}$ of 200 [kg/h]−raw material rate$_{act}$ of 125 [kg/h])/region span of 100 [kg/h]=¾

Char feed rate on the map allowing for the weighting factor=10×½×¾=3.75 [kg/h]

B-term of Eq. (1)

Char feed rate on the map=(water vapor rate$_{max}$, raw material rate$_{min}$)=(200 kg/h, 100 kg/h)=9 [kg/h]

Weighting factor based on the water vapor rate=(water vapor rate$_{act}$ of 150 [kg/h]−water vapor rate$_{min}$ of 100 [kg/h])/region span of 100 [kg/h]=½

Weighting factor based on the raw material rate=(raw material rate$_{max}$ of 200 [kg/h]−raw material rate$_{act}$ of 125 [kg/h])/region span of 100 [kg/h]=¾

Char feed rate on the map allowing for the weighting factor=9×½×¾=3.375 [kg/h]

C-term of Eq. (1)

Char feed rate on the map=(water vapor rate$_{min}$, raw material rate$_{max}$)=(100 kg/h, 200 kg/h)=20 [kg/h]

Weighting factor based on the water vapor rate=(water vapor rate$_{max}$ of 200 [kg/h]−water vapor rate$_{act}$ of 150 [kg/h])/region span of 100 [kg/h]=½

Weighting factor based on the raw material rate=(raw material rate$_{act}$ of 125 [kg/h]−raw material rate$_{min}$ of 100 [kg/h])/region span of 100 [kg/h]=¼

Char feed rate on the map allowing for the weighting factor=20×½×¼=2.5 [kg/h]

D-term of Eq. (1)

Char feed rate on the map=(water vapor rate$_{max}$, raw material rate$_{max}$)=(200 kg/h, 200 kg/h)=18 [kg/h]

Weighting factor based on the water vapor rate=(water vapor rate$_{act}$ of 150 [kg/h]−water vapor rate$_{min}$ of 100 [kg/h])/region span of 100 [kg/h]=½

Weighting factor based on the raw material rate=(raw material rate$_{act}$ of 125 [kg/h]−raw material rate$_{min}$ of 100 [kg/h])/region span of 100 [kg/h]=¼

Char feed rate on the map allowing for the weighting factor=18×½×¼=2.25 [kg/h]

From the above, Equation (1) results in A+B+C+D=3.75+3.375+2.5+2.25=11.875 [kg/h].

The controller 22 is also provided with a second map as shown in FIG. 4 which defines as a number an influence of the temperature in the gasification furnace 1 and the circulated rate of the bed material 4 on the feed rate of the char 7 with the influence number being "1" at the given rated point of the first map (e.g., at the operation state where the temperature in the gasification furnace is 800° C. and the circulated rate of the bed material is 40000 kg/h). The second map shows a trend where the influence number decreases as the temperature in the gasification furnace increases, and increases as the circulated rate of the bed material increases.

Figure 8:
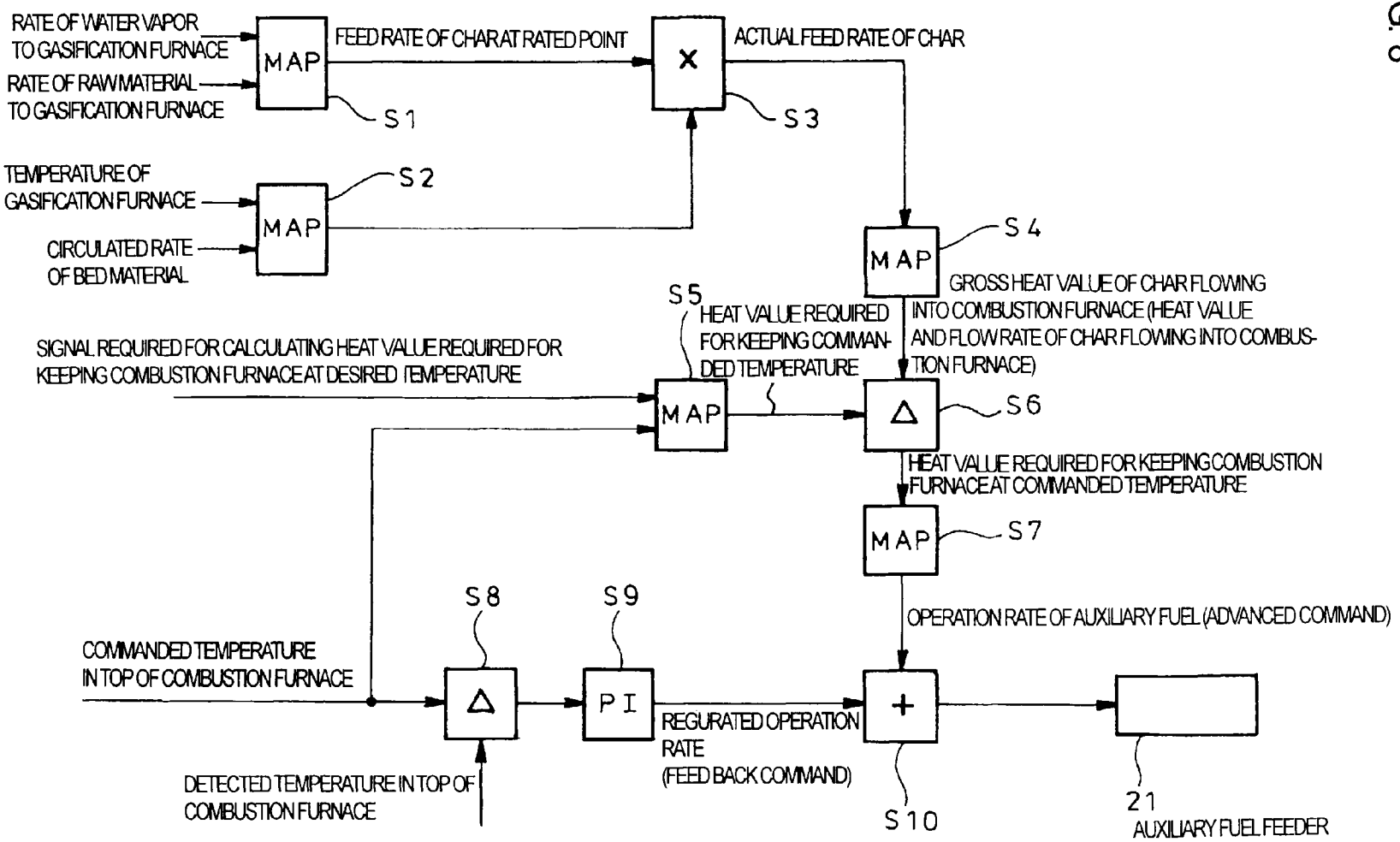
FIG. 8 is a flowchart for the controller in FIG. 2.

As shown in a flowchart in FIG. 8, the controller 22 firstly reads out at step S1 a feed rate of the char 7 at the rated point according to the first map in FIG. 3 from the current flow rate of the water vapor 3 (detected by the flowmeter 14) and the current flow rate of the raw material 5 (calculated on the basis of detection by the revolution sensor 17) to the gasification furnace 1; reads out at step S2 a proper number according to the second map in FIG. 4 from the current temperature of the gasification furnace 1 (detected by the thermometer 18) and the current circulated flow rate of the bed material 4 (detected by the flowmeter 19); and multiplies at step S3 (multiplier) the feed rate of the char 7 at the rated point read out according to the first map at step S1 by the influence number read out according to the second map at step S2 to thereby calculate an actual feed rate of the char 7.

Figures 5, 6:
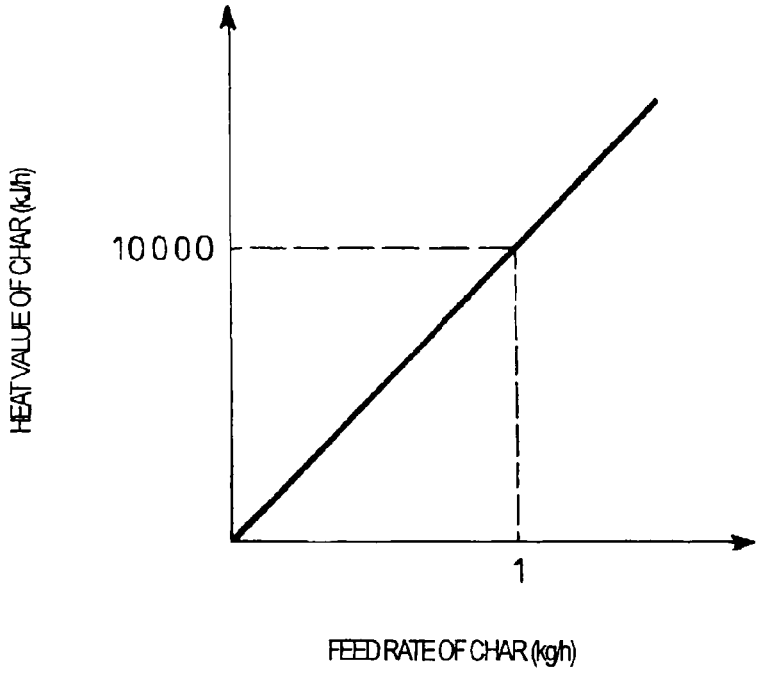
FIG. 5 is a diagram exemplarily showing a third map provided for the controller in FIG. 2.
FIG. 6 is a diagram exemplarily showing a fourth map provided for the controller in FIG. 2.

The controller 22 is further provided with a third map as shown in FIG. 5 which enables readout of a heat value of the char relative to a feed rate of the char, so that as shown in FIG. 8 the controller 22 can read out a gross heat value of the char flowing into the combustion furnace 2 at fourth step S4 according to the third map on the basis of the actual feed rate and heat value of the char from step S3.

The controller 22 is further provided with a fourth map as shown in FIG. 6 which enables readout of a heat value required for keeping a commanded temperature from the relationship between the commanded temperature in the top of the combustion furnace 2 and a flow rate of air to the combustion furnace, so that, as shown in FIG. 8, the heat value required for keeping the combustion furnace 2 at the commanded temperature can be read out by performing subtraction at step S6 between the gross heat value of the char flowing into the combustion furnace 2 read out according to the third map in FIG. 5 at step S4, and the heat value required for keeping the commanded temperature read out according to the fourth map in FIG. 6 at step S5.

Figure 7:
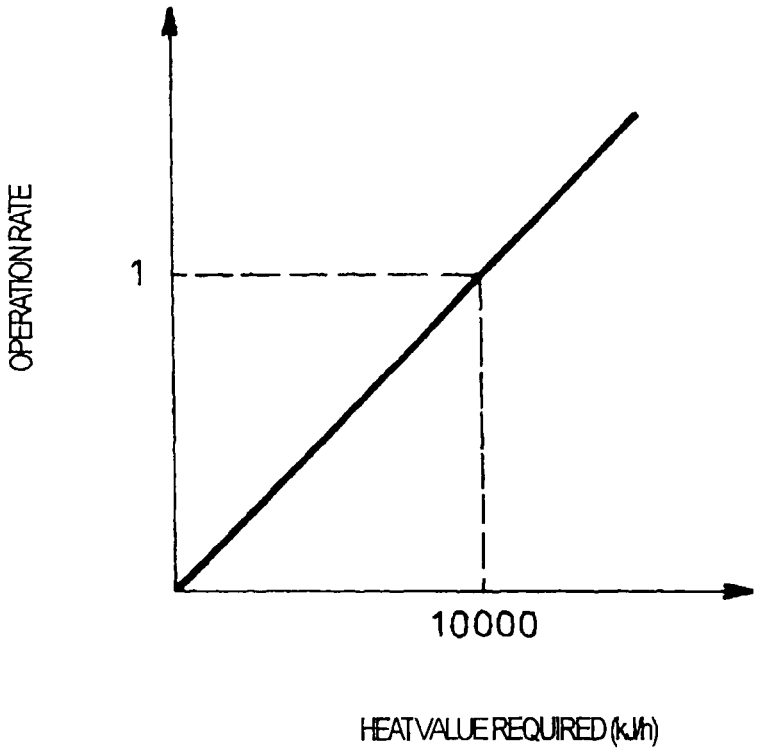
FIG. 7 is a diagram exemplarily showing a fifth map provided for the controller in FIG. 2.

The controller 22 is further provided with a fifth map as shown in FIG. 7 which enables readout of an operation rate of an auxiliary fuel from the relationship between the required heat value from step 6 and the operation rate, so that, as shown in FIG. 8, the operation rate of the auxiliary fuel read out according to the fifth map in FIG. 7 at step 7 is outputted to the auxiliary fuel feeder 21 for an advanced command control of the feeder 21.

Further, as shown in FIG. 8, subtraction is performed at step S8 (subtracter) between the commanded temperature in the top of the combustion furnace 2 and a detected temperature in the top of the furnace 2 by the thermometer 27; step S9 (proportional integrator) is provided for output of a regulated operation rate such that the difference obtained at step S8 becomes zero; and the regulated operation rate from step S9 is added at step S10 (adder) to the operation rate of the auxiliary fuel from step S7 to provide a feedback control.

The first to fifth maps in the controller 22 are prepared in advance on the basis of operational and experimental data and are implemented on software of the controller 22.

Thus, the feed rate of the char 7 from the gasification furnace 1 to the combustion furnace 2, which has been hitherto difficult to definitely grasp, can be calculated by reading out the feed rate of the char 7 at the rated point from the current flow rates of the water vapor 3 and of the raw material 5 to the gasification furnace 1 according to the first map (step S1) in FIG. 3 and multiplying the feed rate of the char 7 read out at the rated point by the number read out from the current temperature of the gasification furnace 1 and circulated flow rate of the bed material 4 according to the second map (step S2) in FIG. 4.

Further, the gross heat value of the char 7 flowing into the combustion furnace 2 is read out according to the third map (step S4) in FIG. 5 which enables readout of the heat value of the char relative to the feed rate of the char. Subtraction between the heat value required for keeping the commanded temperature, which is read out according to the fourth map (step S5) in FIG. 6 from the relationship between the commanded temperature in the top of the combustion furnace 2 and the flow rate of air to the combustion furnace (a signal required for calculating the heat value required for keeping the combustion furnace at a desired temperature), and the gross heat value of the char flowing into the combustion furnace 2 from step S4 is performed at step 6 to determine the heat value required for keeping the combustion furnace 2 at the commanded temperature.

Then, the auxiliary fuel feeder 21 undergoes an advanced control depending on the operation rate of the auxiliary fuel read out from the relationship between the required heat value and the operation rate according to the fifth map (step S7) in FIG. 7.

Further, subtraction is performed at step S8 between the commanded temperature in the top of the combustion furnace 2 and the detected temperature in the top of the combustion furnace 2 by the thermometer 27. Then, the regulated operation rate outputted from step S9 (proportional integrator) such that the difference determined at step S8 becomes zero is added at step S10 (adder) to the operation rate of the auxiliary fuel from step S7 to thereby perform a feedback control for the auxiliary fuel feeder 21.

As mentioned hereinabove, according to the embodiment, the feed rate of the char 7 from the gasification furnace 1 to the combustion furnace 2 can be definitely grasped; and the temperature in the combustion furnace can be controlled at a high accuracy by determining the heat value required for keeping the combustion furnace 2 at the commanded temperature through subtraction between the gross heat value of the char 7 flowing into the combustion furnace 2 determined on the basis of the grasped feed rate of the char and the heat value required for keeping the combustion furnace 2 at the commanded temperature determined from the relationship between the commanded temperature in the top of the combustion furnace and the flow rate of air to the combustion furnace, by determining the operation rate of the auxiliary fuel from the determined heat value to perform the advanced control for the auxiliary fuel feeder 21, and by executing the subtraction between the commanded temperature and the detected temperature in the top of the combustion furnace 2 to regulate the operation rate of the auxiliary fuel such that the difference therebetween becomes zero to perform the feedback control for the auxiliary fuel feeder 21.

It is to be understood that a method and an apparatus for controlling a temperature in a combustion furnace in a gasification equipment according to the invention are not limited to the above illustrated embodiment and that various changes and modifications may be made without departing from the scope of the invention. For example, in lieu of the above map-based controls, a neutral network may be used to calculate an optimum flow rate of coal in the combustion furnace to thereby control the combustion furnace to a desired temperature. Different maps may be prepared and used depending on, e.g., a composition of the gas or a composition of a raw material charged into the gasification furnace.

REFERENCE SIGNS LIST

1 gasification furnace
2 combustion furnace
3 water vapor
4 bed material
5 raw material
6 gasification gas
7 char
8 air
9 combustion exhaust gas

14 flowmeter for water vapor (water vapor rate detection means)
17 revolution sensor (raw material rate detection means)
18 thermometer for gasification furnace (gasification furnace temperature detection means)
19 flowmeter for circulated bed material (circulated bed material flow rate detection means)
20 air flowmeter for combustion furnace (combustion furnace air flow rate detection means)
21 auxiliary fuel feeder
21*a* revolution sensor (auxiliary fuel rate detection means)
22 controller
27 thermometer for combustion furnace (combustion furnace temperature detection means)

INDUSTRIAL APPLICABILITY

A method and an apparatus for controlling an temperature in a combustion furnace in a gasification equipment can grasp a feed rate of char flowing from a gasification furnace to the combustion furnace to stably control the temperature in the combustion furnace.

The invention claimed is:

1. A method for controlling a temperature in a combustion furnace in a gasification equipment comprising a gasification furnace for gasifying a raw material through formation of a fluidized bed by introduction of water vapor and a combustion furnace for blowing up with air the bed material introduced together with unreacted char from said gasification furnace to heat the bed material through combustion of said char, the bed material heated in said combustion furnace being separated from a combustion exhaust gas and returned to said gasification furnace, the method comprising:

providing a first map for defining a feed rate of the char from the gasification furnace to the combustion furnace on the basis of a rate of the water vapor and a rate of the raw material to the gasification furnace at a rated point and a second map for defining as number an influence of a temperature in the gasification furnace and a circulated rate of the bed material on said feed rate of the char;

reading out the feed rate of the char at the rated point from a current rate of the water vapor and a current rate of the raw material to the gasification furnace according to the first map, reading out an influence number from a current temperature in the gasification furnace and a current circulated rate of the bed material according to the second map, and multiplying the feed rate of the char at said rated point by said influence number to thereby calculate an actual feed rate of the char;

providing a third map for defining a gross heat value of the char flowing into the combustion furnace on the basis of said actual feed rate and heat value of the char, and a fourth map for defining a heat value required for keeping a top of the combustion furnace at a commanded temperature on the basis of the commanded temperature in the top of the combustion furnace and a flow rate of air to the combustion furnace;

reading out the gross heat value of the char flowing into the combustion furnace according to said third map, reading out the heat value required for keeping the top of the combustion furnace at the commanded temperature according to the fourth map and performing a subtraction between the both to thereby calculate a heat value required for keeping the temperature in the combustion furnace;

providing a fifth map for determining an operation rate of an auxiliary fuel from said required heat value to perform an advanced control for an auxiliary fuel feeder so as to achieve said operation rate of the auxiliary fuel; and providing a proportional integrator for adding a regulated operation rate to said auxiliary fuel operation rate so as to make zero a difference obtained as a result of subtraction between the commanded temperature and a detected temperature in the top of said combustion furnace to perform a feedback control for said auxiliary fuel feeder.

2. An apparatus for controlling a temperature in a combustion furnace in a gasification equipment comprising a gasification furnace for gasifying a raw material through formation of a fluidized bed by introduction of water vapor and a combustion furnace for blowing up with air the bed material introduced together with unreacted char from said gasification furnace to heat the bed material through combustion of said char, the bed material heated in said combustion furnace being separated from a combustion exhaust gas and returned to said gasification furnace, the apparatus comprising:

water vapor rate detection means for detecting a rate of the water vapor to the gasification furnace;

raw material rate detection means for detecting a rate of the raw material to the gasification furnace;

gasification furnace temperature detection means for detecting a temperature in the gasification furnace;

bed material circulated rate detection means for detecting a circulated rate of the bed material;

combustion furnace air flow rate detection means for detecting a flow rate of air to the combustion furnace;

combustion furnace temperature detection means for detecting a temperature in a top of the combustion furnace;

auxiliary fuel feed rate detection means for detecting a feed rate of an auxiliary fuel to the combustion furnace; and a controller with a first map for defining a feed rate of the char from the gasification furnace to the combustion furnace on the basis of the rate of the water vapor and the rate of the raw material to the gasification furnace at a rated point; a second map for defining as number an influence of the temperature of the gasification furnace and the circulated rate of the bed material on said feed rate of the char; a multiplier for multiplying the feed rate of the char at a rated point read out from a current rate of the water vapor and a current rate of the raw material to the gasification furnace according to the first map by the number read out from a current temperature in the gasification furnace and a current circulated rate of the bed material according to the second map to thereby calculate an actual feed rate of the char;

a third map for defining a gross heat value of the char flowing into the combustion furnace on the basis of said actual feed rate and heat value of the char and;

a subtracter for a subtraction between the gross heat value of the char flowing into the combustion furnace read out according to said third map and the heat value required for keeping the top of the combustion furnace at the commanded temperature read out from the commanded temperature in the top of the combustion furnace and the flow rate of air to the combustion furnace according to the fourth map to determine an heat value required for keeping the combustion furnace at the commanded temperature;

a fifth map for readout of an operation rate of an auxiliary fuel from said required heat value so as to output an advanced command to an auxiliary fuel feeder; and a subtracter for performing a subtraction between said commanded temperature and a detected temperature in the top of said combustion furnace and a proportional integrator for regulating said operation rate of the auxiliary fuel such that a difference obtained by the subtracter becomes zero so as to provide a feedback control for said auxiliary fuel feeder.

* * * * *